US006178700B1

(12) United States Patent
Mayer, Jr.

(10) Patent No.: US 6,178,700 B1
(45) Date of Patent: Jan. 30, 2001

(54) DOOR FRAME REINFORCING STRUCTURE

(75) Inventor: Frederic C. Mayer, Jr., Hoover, AL (US)

(73) Assignee: Alabama Metal Industries Corporation, Birmingham, AL (US)

( * ) Notice: Under 35 U.S.C. 154(b), the term of this patent shall be extended for 0 days.

(21) Appl. No.: 09/359,600

(22) Filed: Jul. 23, 1999

(51) Int. Cl.[7] ..... E06B 1/04
(52) U.S. Cl. ..... 49/504; 52/210
(58) Field of Search ..... 49/504, 460; 52/210; 292/340, 346

(56) References Cited

U.S. PATENT DOCUMENTS

| | | | | |
|---|---|---|---|---|
| 3,385,004 | | 5/1968 | Oehler et al. . | |
| 3,676,966 | | 7/1972 | Ragland . | |
| 3,767,245 | * | 10/1973 | Keefe | 292/340 |
| 3,918,207 | | 11/1975 | Aliotta . | |
| 4,057,275 | | 11/1977 | La Beaud . | |
| 4,174,862 | | 11/1979 | Shane . | |
| 4,295,299 | | 10/1981 | Nelson . | |
| 4,631,866 | * | 12/1986 | Otto et al. | 49/504 |
| 4,684,160 | | 8/1987 | Nelson . | |
| 4,717,185 | | 1/1988 | Hartley . | |
| 4,719,729 | | 1/1988 | Wynar . | |
| 4,770,452 | | 9/1988 | Petree, Jr. . | |
| 4,802,701 | | 2/1989 | Mazie . | |
| 4,858,384 | * | 8/1989 | Blankenship | 49/504 X |
| 5,024,475 | * | 6/1991 | Francis | 292/346 X |
| 5,193,380 | | 3/1993 | Davidian . | |
| 5,241,790 | | 9/1993 | Schimpf . | |
| 5,490,353 | * | 2/1996 | McLaughlin | 49/64 |
| 5,566,509 | | 10/1996 | Long . | |
| 5,584,157 | | 12/1996 | Sun . | |
| 5,619,823 | | 4/1997 | Ruff et al. . | |
| 5,640,808 | | 6/1997 | Simeone et al. . | |
| 5,711,121 | | 1/1998 | Garver . | |

* cited by examiner

*Primary Examiner*—Jerry Redman
(74) *Attorney, Agent, or Firm*—Alston & Bird LLP

(57) ABSTRACT

An apparatus for reinforcing a door frame, comprising a pair of elongated metal plates extending substantially the length and width of the jambs forming either side of the door frame. Each of the metal plates defines a plurality of attachment holes for attaching the plates individually to the back sides of each of the jambs with fasteners passing therethrough. In addition, each plate defines a plurality of installation holes for allowing the door frame to be secured in the framed opening with fasteners passing through the jambs, the installation holes, and into adjacent members of the framed opening. Each plate further defines a plurality of openings along the lengths thereof, which allows attachment of appropriate hinges or strike plate to the front side of the corresponding jamb by fasteners passing through the hinge or strike plate, the jamb, the openings, and into an adjacent member of the framed opening.

18 Claims, 4 Drawing Sheets

DOOR FRAME REINFORCING STRUCTURE

FIELD OF THE INVENTION

The present invention relates to door reinforcing devices and, more particularly, to a universal door frame reinforcing structure.

BACKGROUND OF THE INVENTION

Doors forming entranceways into houses and other buildings, and even into individual rooms in buildings, are often provided for installation already "pre-hung" in a door frame (also referred to herein as a "frame"). Doors and corresponding frames may further be provided in both standard and custom sizes and configurations. Pre-hanging the door in a frame means that the hinges and the locking device (or openings therefor) are already aligned and/or installed between the door and the frame. Thus, the frame merely needs to be placed in a framed opening in the proper location and secured in place for the door to be a functional entranceway. No further alignment of the door within the frame is required. Thus, a pre-hung door comprises a convenient and time saving means for installing a door in a building.

A door frame typically includes an outer molding on one edge of the frame, forming a lip generally around the top and the sides thereof. The framed opening in which the frame is inserted is constructed of interconnected framing members configured to generally accommodate the outer dimensions of the frame. One face of the framed opening thus defines part of the outer wall of the room or building and the other face defines part of the inner wall. Installation of the pre-hung door in the framed opening generally comprises sliding the frame into the framed opening such that the outer molding lip fits flush with the outer wall side of the framed opening. The frame is then shimmed into proper alignment within the framed opening. A molding is then attached to the inner wall side of the framed opening, typically covering the top and both sides of the frame and extending between the frame and the framed opening. A lip is thereby formed on the inner wall side of the framed opening, opposing the lip formed by the outer molding, securing the frame in the framed opening.

While the frame is generally secured within the framed opening by the outer molding and the opposing inner molding, the door itself is attached only to the frame. That is, the door hinges and the strike plate are attached to the frame by fasteners, wherein the hinges are attached to the hinge jamb and the strike plate is attached to the strike jamb. The hinges attach to the door and allow the door to swing open and closed within the frame. The strike plate engages the door by accommodating the locking element of the locking device when the door is in the closed position. Usually, however, a typical door has three hinges, but only one locking device (thus only one strike plate on the strike jamb with which to engage). This typical door configuration presents a problem where entry into a building or a room is being attempted by force, i.e. in the event of a break-in.

Where a door is being kicked or battered in the event of a break-in using forced entry, the hinge side of the frame generally has three hinges connected between the door and the hinge jamb over which to distribute the force applied against the door. On the other hand, the force on the strike plate side of the frame is concentrated in the vicinity of the strike plate on the strike jamb. Thus, the strike jamb is most likely to fail from the force applied to the door, rather than the hinge jamb. More specifically, where the strike jamb is made of a soft material such as wood, aluminum, or thin metal, the strike jamb is likely to splinter, deform, or break in the vicinity of the strike plate, thus allowing the door to open. However, it is also possible, since the hinges are just screwed into the frame, for the screws securing the hinges to strip out of the hinge jamb or for the hinge jamb to fail, thus causing the hinge side of the door to fail. Due to these shortcomings with pre-hung doors, a number of attempts have been made to increase the resistance of door frames to breaking forces applied thereto.

For example, U.S. Pat. No. 5,241,790 to Schimpf discloses a kick-proof door jamb reinforcing means and assembly comprising a reinforcing plate mounted in back of the door jamb on the strike plate side in the space between the jamb and the framed opening. Shims are used to temporarily jam the plate between the already installed door jamb and the framed opening while a drill is used to drill directly through the face of the door jamb into the plate at locations at which it is desired to secure the plate to the door jamb. Self-tapping one-way fasteners are then threaded through the bores drilled in the door jamb directly into the plate where they thread into the plate and hold it securely against the door jamb. Openings are also drilled through the strike plate screw holes directly into the reinforcing plate and the strike plate is then secured firmly to the plate by self-tapping screws, machine bolt fastenings, or special fastenings to provide metal-to-metal contacts between the parts.

While the '790 patent provides a reinforcing means for a door jamb, it addresses only the strike plate side of the door frame. As previously discussed, with a pre-hung door, the hinges are usually attached only to the door frame. The fasteners securing the hinges do not pass into the framing members forming the framed opening. By reinforcing only the strike jamb and not the hinge jamb, the hinge jamb becomes a weak point on the frame and therefore more likely to fail when force is being applied to break open the door. Further, the '790 patent discloses that the reinforcing plate is attached solely to the back of the strike jamb by fasteners passing through the jamb and into the plate. The fasteners do not extend into the adjacent framing members. The plate is inserted into the space between the framed opening and the frame after the frame has been installed in the framed opening. Once the plate is wedged into place, holes in the jamb and plate must then be drilled before self-tapping screws are installed in the jamb to secure the plate therebehind. The strike plate is then attached to the strike jamb with self-tapping screws passing through the holes in the strike plate, the jamb, and into the plate. Thus, the installation of the reinforcing plate according to the '790 patent comprises securing the reinforcing plate only to the back of the strike jamb. Further, since the plate is only wedged into place while the installation holes are drilled and not securely fastened to the back of the jamb, the plate may shift between the drilling of successive holes for installing the plate. In addition, with most doors, the frame is secured within the framed opening by just the opposing moldings, whereby entry into the building/room may still be gained by removing the outer molding around the outside of the door frame. By forcing the frame inward after the outer molding is removed, the frame can drop out of the framed opening since the frame is not secured within the framed opening by fasteners passing through the frame and into adjacent framing members.

In another example, U.S. Pat. No. 4,770,452 to Petree, Jr. discloses a concealed door frame security device comprising an elongated rigid plate inserted into a slot and firmly anchored in place in the door jamb in spaced parallel relation to the free vertical edge of the door. The plate is provided with an opening aligned with an opening in the door jamb, and the spacing between the plate and the face of the door jamb is such that the locking element will project through the aligned openings in the door jamb and the plate. The slot is formed by routing the door jamb intermediately between its inner surface and an offset surface portion and to a depth extending beyond the offset surface portion into the wider portion of the door jamb. To anchor the plate within the slot, openings are formed at spaced intervals along the length of the plate and adapted to receive threaded fasteners in the form of wood screws which are threaded through the door jamb offset surface section, the openings in the plate, and into the stud members forming the framed opening and surrounding the door frame.

The '452 patent provides a concealed means for a reinforcing a door jamb. However, the apparatus disclosed by the '452 patent addresses only the strike plate side of the frame. Further, in order to install the reinforcing plate in the frame, a slot must be routed into the frame to accommodate the plate. Once inserted into the slot in the frame, the plate is fastened therein by fasteners extending through the door jamb, pre-drilled holes in the plate, through the remainder of the door jamb, and into the adjacent framing member. The plate further contains pre-cut openings for engaging locking devices attached to the door. Thus, the apparatus disclosed by the '452 patent can be difficult to install because of the routing or milling of the door frame which is required to form the slot into which the plate is inserted. Further, drilling installation holes through the door jamb to correspond with the pre-drilled holes in the plate can also be difficult, especially since the plate is not securely attached to the jamb within the slot and may shift between the drilling of successive holes. In addition, the pre-cut openings in the plate which engage the locking device(s) must be precisely aligned with the pre-existing openings in the door jamb in order for the locking devices to function as intended.

In another example, U.S. Pat. No. 3,918,207 to Aliotta discloses a door frame protector comprising a plate adapted for attachment to the hidden outer face of an upstanding frame side member and a flange adapted for engagement with the inside edge of the frame side member. This device is formed from a generally rectangular sheet of rigid material having one edge turned up generally perpendicular to the sheet, forming the flange. The door frame protector is arranged so that the plate engages the concealed outer surface of the side member and the flange is mortised into the inside edge of the side member. The door frame protector is attached to the frame side member either by screws passing through the protector into the side member or by screws passing through the side frame to engage with threaded holes in the protector.

The '207 patent discloses a door frame protector which comprises an L-shaped plate installed between the strike jamb and the framed opening for reinforcing the jamb. The apparatus disclosed by the '207 patent also addresses only the strike plate side of the frame. While the plate is just inserted between the back side of the strike jamb and the adjacent framing member, the inside edge of the jamb must be milled or mortised in order for the flange to fit flush therewith. In addition, the plate is attached only to the jamb either by screws passing through the plate into the jamb or by screws passing through the jamb to engage with threaded holes in the plate. As such, entry into the building/room may still be gained by dismantling the outer molding around the outside of the frame and forcing the frame inward. Since the frame is not secured to the adjacent framing members, the frame can drop out of the framed opening, allowing entry into the building/room. Further, where fasteners pass through the jamb to engage with pre-threaded holes in the plate, drilling holes through the jamb to correspond with the holes in the plate can be difficult, especially since the plate is not securely attached to the jamb and may shift between the drilling of successive holes. Another aspect of the apparatus disclosed by the '207 patent is that the screws securing the strike plate to the strike jamb do not engage the plate. As such, should the flange deform or fail in the event that force is applied to the door, the strike plate is not otherwise tied to the reinforcing plate and the strike jamb will therefore also fail.

In still another example, U.S. Pat. No. 5,566,509 to Long discloses a door jamb reinforcing strip comprising an elongated strip having an L-shaped transverse cross-section comprising one short leg and one long leg, the long leg for mounting on a door jamb face and the short leg for mounting on a door jamb edge. The long leg includes a plurality of openings spaced over the entire length of the strip and is adapted to seat screws or receive a door latch tongue therein. The short leg of the strip has a transverse extent which is no greater than the offset distance between the door jamb face and the forward edge of the door casing panel, such that when the long leg of the reinforcement strip is mounted on the door jamb face, the short leg of the reinforcement strip is mounted flush with the door jamb edge and is in contact with or slightly spaced from the forward edge of the door casing. In sum, the reinforcement strip forms an interior corner that is adapted to fit over an outside vertical corner of a door jamb and form a reinforcement therefor. The reinforcement strip is secured to the door jamb by a plurality of long wood screws which extend through the door jamb, through a spacer, and into the adjacent wall stud forming part of the framed opening.

The '509 patent discloses an L-shaped reinforcing strip for a door jamb wherein the strip includes pre-formed openings to engage the locking element attached to the door. The strip is placed on the doorjamb such that the short leg of the strip wraps around the inner edge of the strike jamb. The strip is then attached to the jamb by fasteners passing through pre-drilled holes in the strip, the strike jamb, and into the adjacent framing member. However, the apparatus disclosed by the '509 patent addresses only the strike plate side of the door frame. Further, even though the strip may be effective in reinforcing the door frame, its installation on the front face of the strike jamb can make it aesthetically unappealing in some situations.

Thus, there exists a need for an apparatus for reinforcing a pre-hung door unit which comprises a door pre-aligned in a frame. It would be desirable for the apparatus to be concealable and easy to install without requiring milling, routing, or other machining of the frame. In addition, it would be desirable for the apparatus to address both the strike jamb and the hinge jamb and provide a means for reinforcing both. Further, it would be desirable for the apparatus to be able to accommodate varying strike plate and hinge locations without requiring modification of the apparatus or complex alignment thereof. It is also preferred that the apparatus be securable to the jambs such that subsequent installation steps may be performed without the apparatus shifting position. The apparatus should also preferably be able to accommodate multiple locking devices, each having a locking element engaging the strike jamb, without requiring modification or complex alignment thereof. In addition, it would be desirable for the apparatus to reinforce the frame while also reinforcing the connection between the door frame and the adjacent framing members forming the framed opening. In addition to the preceding preferences, the apparatus should also preferably be easily installable on new pre-hung door units before the units are installed, as well as readily adaptable for retrofitting and reinforcing door frames which have already been installed.

SUMMARY OF THE INVENTION

The above and other needs are met by the present invention which, in a preferred embodiment, comprises a pair of elongated metal plates extending substantially the length and width of the hinge and strike jambs. Each of the metal plates defines a plurality of attachment holes for attaching the plates individually to the back sides of each of the jambs with fasteners passing therethrough. In addition, each plate defines a plurality of installation holes for allowing the door frame to be secured in, and to be attached to, the framed opening with fasteners passing through the jambs, the installation holes, and into adjacent framing members.

Each plate further defines a plurality of elongated openings along the lengths thereof. For the plate attached to the hinge jamb, the openings allow attachment of corresponding hinges to the front side of the hinge jamb by fasteners passing through the hinges, the hinge jamb, the openings, and into an adjacent framing member. For the plate attached to the strike jamb, the openings allow attachment of at least one strike plate to the front side of the strike jamb by fasteners passing through the strike plate, the strike jamb, at least one opening, and into an adjacent framing member. The hinges further attach to one vertical edge of the door and the strike plate further engages at least one corresponding locking device attached along the other vertical edge of the door to secure the door within the frame.

Another aspect of the present invention further provides a preferred method for reinforcing a door frame received in a plurality of interconnected framing members defining a framed opening, the door frame comprising a hinge jamb and a strike jamb, with each jamb having a front side facing a vertical edge of a door accommodated within the door frame and a back side facing away from the same vertical edge of the door. The first step of the method is attaching a pair of metal plates individually on the back side of each of the jambs, where the plates extend substantially the length and width of the jambs and each plate defines a plurality of attachment holes for attaching the plates to the jambs with fasteners passing therethrough. After the plates are attached to the door frame, the door frame is installed in the framed opening with fasteners passing through the jambs, a plurality of installation holes further defined by each metal plate, and into adjacent framing members of the framed opening.

Once the door frame is secured within the framed opening, a plurality of hinges is secured to the front side of the hinge jamb by fasteners passing through the hinges, the hinge jamb, a plurality of elongated openings further defined by the plate attached to the hinge jamb, and into an adjacent framing member. The hinges further attach to one vertical edge of the door, allowing the door to swing between an open and a closed position. Having secured the door on the hinges, at least one strike plate is then secured to the front side of the strike jamb by fasteners passing through the strike plate, the strike jamb, at least one elongated opening further defined by the plate attached to the strike jamb, and into an adjacent framing member. The strike plate further engages at least one corresponding locking device attached to the door to secure the door in the closed position or to release the door so that it may swing open.

A preferred embodiment of the present invention thus provides an apparatus for reinforcing a pre-hung door unit by providing a pair of metal plates for reinforcing both sides or jambs of the door frame. Once installed, the plates are concealed between the jamb and the framed opening. The plates are easy to install and do not require milling, routing, or the like of the door frame for the installation thereof. A preferred embodiment of the present invention further addresses both the strike jamb and the hinge jamb and provides a means for reinforcing both. In addition, by the elongated openings disposed along the lengths of the plates, a preferred embodiment of the present invention serves to accommodate varying strike plate and hinge locations without requiring modification of the plates or complex alignment thereof in relation to the door frame. Preferably, the plates each have three openings disposed along the length thereof. Thus, the plate attached to the strike jamb can accommodate multiple strike plates, each engaging a corresponding locking element attached to the door, without requiring modification of the plate or complex alignment thereof in relation to the strike jamb. In addition, the plates reinforce the door frame while allowing fasteners to pass therethrough into adjacent framing members in order to secure the door frame within the framed opening, thereby preventing an alternate route to entry by removing the door frame from the framed opening. In addition to the preceding advantages, the plates are easily installable on new pre-hung door units before the units are installed. Further, the plates are readily adaptable for retro-fitting and reinforcing a door frame which has already been installed in a framed opening. According to a preferred embodiment of the present invention, the plate reinforcing the strike jamb is preferably identical to the plate reinforcing the hinge jamb and, since the elongated openings are disposed along the length of the plates, the plate reinforcing the strike jamb may further reinforce the break-in resistance of the door by accommodating a plurality of strike plates for engaging corresponding locking elements disposed along the edge of the door. Still further, the plates reinforce the door frame without having precise pre-formed openings or holes therein which must be exactly aligned with the corresponding features in the door frame. Instead, the plates have elongated openings to accommodate fasteners securing hinges or strike plates to the appropriate jamb, thus providing "universal" applicability of the apparatus to doors having various locations and amounts of hinges and locking devices. A preferred embodiment of the present invention thus reinforces the door frame by transforming the door jambs into metal-wood-metal-wood composites formed by the hinge/strike plate, the jamb, the plate, and an adjacent framing member secured together by the fasteners passing therethrough.

BRIEF DESCRIPTION OF THE DRAWINGS

Some of the advantages of the present invention having been stated, others will appear as the description proceeds, when considered in conjunction with the accompanying drawings, which are not necessarily drawn to scale, and in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
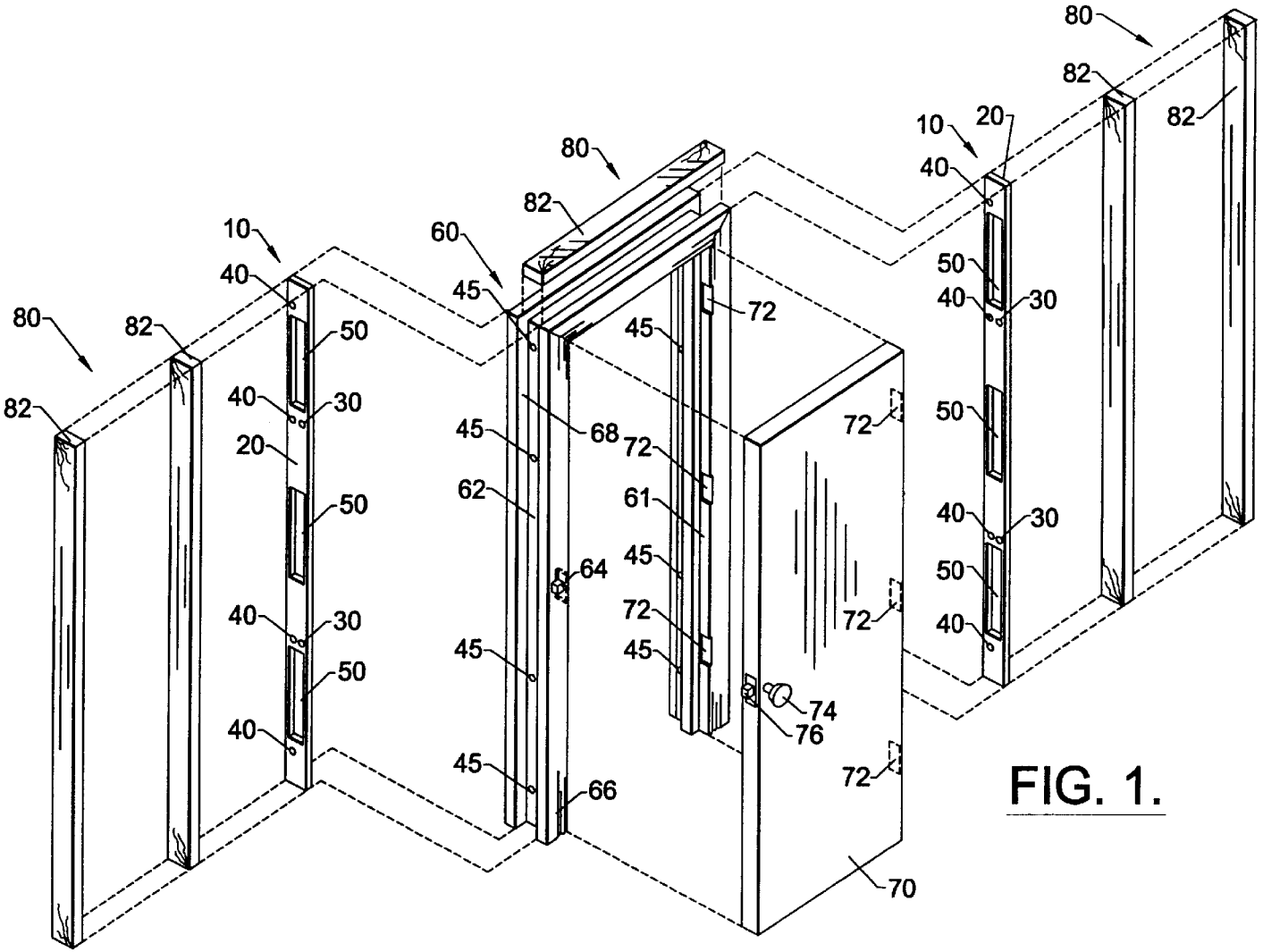
FIG. 1 is an exploded perspective view of a preferred embodiment of the present invention in relation to a door frame.
Figure 2:
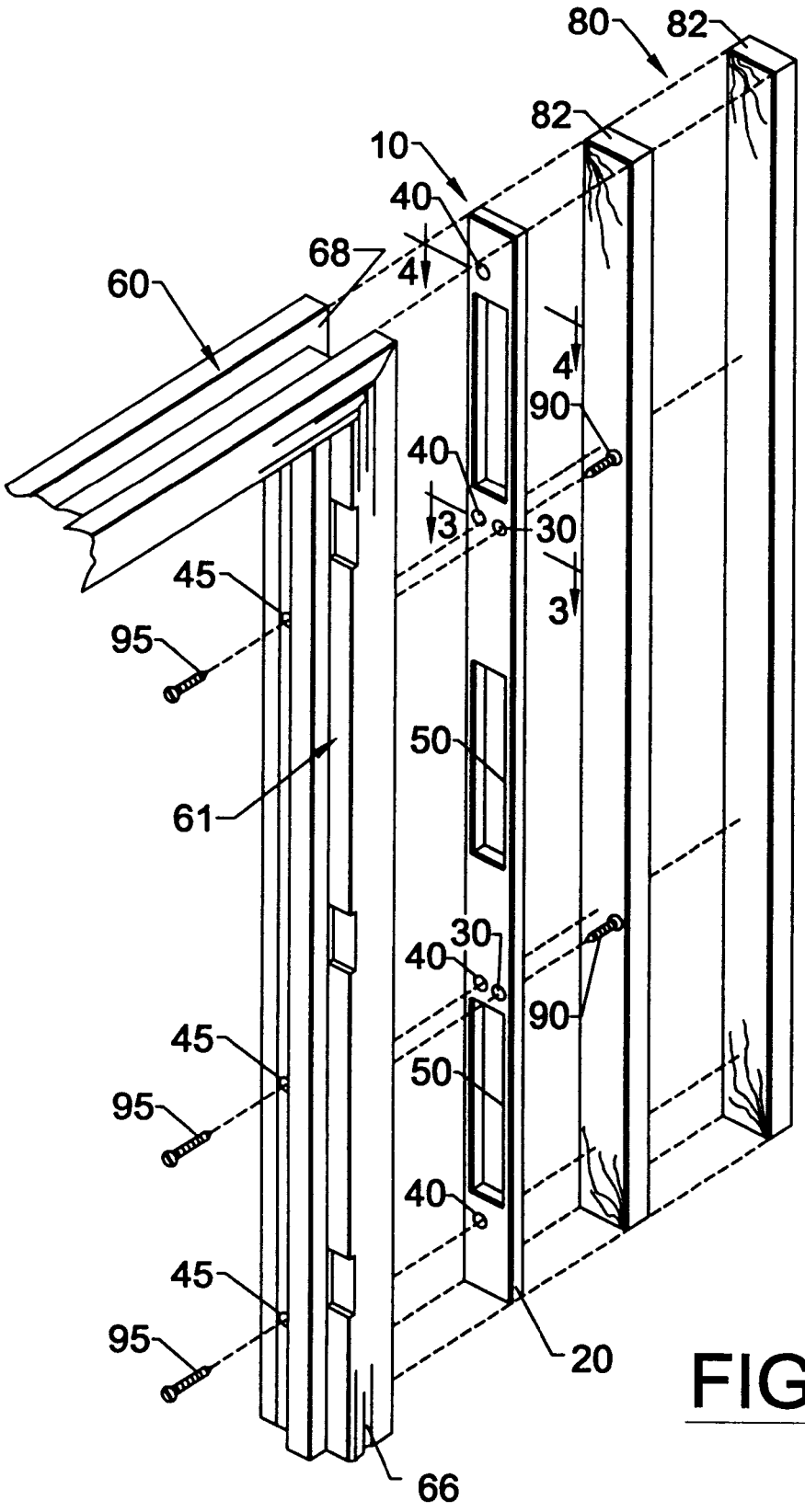
FIG. 2 is an exploded perspective view of a preferred embodiment of the present invention showing a plate between the frame and adjacent framing members.

FIGS. 1 and 2 show a preferred embodiment of a door frame reinforcing apparatus, indicated generally by the numeral 10, which includes the features of the present invention. The door frame reinforcing apparatus 10 comprises a pair of elongated metal plates 20, each further defining a plurality of attachment holes 30, a plurality of installation holes 40, and a plurality of elongated openings 50. In a preferred embodiment, the plates 20 are individually attached to the back sides of the hinge jamb 61 and strike jamb 62 members of a door frame 60. In addition, the length and width dimensions of the plates 20 are preferably substantially the same as, or slightly smaller than, the length and width of the door jambs 61 and 62. Installed in the door frame 60 is a door 70 attached to and engaging the door frame 60 through one or more hinges 72 and one or more locking devices 74 having corresponding locking elements 76. Each locking element 76 engages a corresponding strike plate 64 attached to the strike jamb 62. The door frame 60 is further inserted into a plurality of interconnected framing members 82 defining a framed opening 80 in a wall of a room or a building, thus forming an operative entranceway thereinto.

In further detail, the plates 20 are generally flat and, in a preferred embodiment, are made of heavy gauge steel, such as a minimum of 12 gauge steel. In addition, since pre-hung doors tend to be manufactured in "standard" sizes, the plates 20 preferably roughly correspond to the dimensions of the standard door sizes. For instance, a typical entrance door 70 is about 80 inches tall and requires a rough framed opening 80 of about 83 inches high to accommodate the height of the frame 60 surrounding the door 70 (though the size of the door 70 may vary considerably, for instance, from shorter than 80 inches to a height of 9 feet or more, thus causing the rough framed opening 80 to accordingly vary in size). The height of the framed opening 80 also provides some clearance above floor level for the door 70 to swing between an open and a closed position. Further, the framed opening 80 is usually constricted of two-by-four framing members 82 (which may be wood, metal, or the like) which have drywall or sheathing affixed to either side thereof before the door frame 60 is installed, thereby providing a wall thickness of approximately 4 inches. Thus, the plates 20 may be, for example, about 79 or 80 inches long by up to about 4 inches wide (such as 3½ inches wide in one embodiment) to substantially cover the back sides of each of the jambs 61 and 62. However, while the description refers to standard sizes of pre-hung door units, generally between six and eight feet high, it is understood that the invention as described herein is applicable and adaptable to a wide variety of door units, both standard and custom made (which may be nine feet or more high), and not limited to standard pre-hung door units. Accordingly, the dimensions of the plate may be, for instance, at least 3 inches wide and between about 70 inches and about 110 inches in height. Note also that, while a single plate for reinforcing each of the hinge jamb and the strike jamb are described herein, there may be instances where the unit has more than one plate for reinforcing each of the hinge jamb and the strike jamb. For instance, multiple plates may placed adjacent each other and used to reinforce the hinge jamb and/or the strike jamb, wherein the plates may vary in gauge size, material specification, or other properties. Thus, it is understood that the number, the gauge size, and/or other properties of the plates for reinforcing the hinge jamb and/or the strike jamb may be varied in an appropriate manner to provide a door frame reinforcing structure according to the requirements of the particular application without departing from the scope and spirit of the present invention.

As a matter of background, the frame 60 of a pre-hung door unit is typically constructed of wood, aluminum, fiberglass, a thin sheet metal, or the like. The door 70 may be made of wood, fiberglass, a steel clad material, or the like. One edge of the door 70 is typically attached to the frame 60, more specifically to the hinge jamb 61, by a plurality of hinges 72 of which there are typically three in number. The other edge of the door 70 typically has a locking device 74 which engages the strike plate 64 attached to the strike jamb 62, via a locking element 76. Generally, the locking element 76 passes through the strike plate 64 and partially into the strike jamb 62 to secure the door 70 in a closed position.

In addition, the frame 60 typically has an outer molding 66 attached to and overlapping at least the sides and the top of one edge of the frame 60 and forming a lip. To install the pre-hung door unit in the wall, the frame 60 is slid into the framed opening 80 until the outer molding 66 is flush against the outer wall surface. The frame 60 is then aligned within the framed opening 80, typically with shims. To secure the frame 60 within the framed opening 80, an inner molding 68 is then applied to the frame 60 in an overlapping manner around the top and the sides of the inner edge thereof, forming a lip. The inner molding 68 extends across to the inner wall surface, opposing the lip formed by the outer molding 66 against the outer wall surface, and thus securing the frame 60 within the framed opening 80.

With this typical installation of a pre-hung door unit, problems may arise when entry through the doorway is being sought by force or other means, such as in the event of a break-in. When force is applied against the door 70, the resulting stress will be concentrated at the hinges 72 and at the point where the strike jamb 62, the strike plate 64, and the locking element 76 engage. If the applied force is great enough, both the hinge jamb 61 and the strike jamb 62 may fail where the hinges 72/strike plate 64 are attached. However, the hinge jamb 61 has three hinges 72 over which to distribute the applied force, whereas the force on strike jamb 62 is concentrated in the area of the strike plate 64. As such, the strike jamb 62 is more likely to fail.

If the applied breaking force is not successful in breaking either jamb 61 or 62, the door frame 60 may still be prone to "racking," especially if the multiple adjacent framing members 82 form the framed opening 80. Racking occurs where multiple adjacent members, such as the framing members 82 and the jamb, have a shear force applied thereto and, as a result move relative to each other (for example, like a deck of playing cards being spread across a table). Thus, if the frame 60 racks with respect to the framing members 82, the locking element 76 may become disengaged from the strike plate 64/strike jamb 62 and allow the door 70 to swing open. As an alternative to applying a breaking force to the door 70, entry into the building/room may also be gained by removing the outer molding 66 from the outer wall side of the frame 60. Once the outer molding 66 is removed, the frame 60 may then be pushed through the framed opening 80 since the frame 60 is generally not securely fastened to the adjacent framing members 82 forming the framed opening 80.

Advantageously, in a preferred embodiment of the present invention, the plates 20 are installed on a pre-hung door unit before installation of the unit in the framed opening 80 in the wall of the building. By attaching the plates 20 to the frame 60 before the frame 60 is installed in the framed opening 80, the plates 20 can be roughly placed in proper alignment. For instance, typical pre-hung entrance doors have three hinges 72 securing the door 70 to the hinge jamb 61. However, while there are typically three hinges 72 in a pre-hung door unit, the precise locations of the hinges 72 can vary between units. Thus, the plates 20 are preferably provided with three elongated openings 50 spaced apart and located along the length of the individual plate 20 to correspond to the general locations of the three hinges 72. The openings 50 are elongated to allow for different spacings and alignment of the hinges 72, thus providing a "universal" plate 20 for attachment to a wide variety of pre-hung door units. Accordingly, before the frame 60 is installed, a plate 20 may be placed on the back side of the hinge jamb 61, with the openings 50 roughly aligned with the locations of the hinges 72, and secured thereto by fasteners 90 passing through the attachment holes 30 (which are, for example, ⅛ inch in diameter) in the plate 20 and into the back side of the hinge jamb 61. The fasteners 90 attaching the plate 20 to the hinge jamb 61 may be, for example, ¾ inch screws, 4d nails, or the like and of sufficient length to secure the plate 20 to the hinge jamb 61 without passing completely through the jamb. Note that, while a typical pre-hung door unit has three hinges, there may be instances where the unit has more or less than three hinges. It is understood that the door frame reinforcing structure of the present invention may be adapted to those cases by increasing or decreasing the number, spacing, or dimensions of the openings therein in an appropriate manner without departing from the scope and spirit of the present invention.

Continuing in further detail, the pre-hung door unit typically has a single primary locking device 74 having a single locking element 76. In certain instances, an additional locking device 74, such as a deadbolt, may be provided in general proximity to the primary locking device 74. In general, the locking device(s) 74 are medially positioned along the edge of the door 70, opposing the center hinge 72. The locking element(s) 76 further engage corresponding strike plate(s) 64 and the strike jamb 62. Thus, the plate 20 attached to the back side of the strike jamb 62 also has an elongated opening 50 medially located along the length thereof.

Further, in a preferred embodiment of the present invention, the plate 20 attached to the hinge jamb 61 is identical to the plate 20 attached to the strike jamb 62, each having three elongated openings 50 with one opening 50 being generally medially located along the lengths thereof. This reduces manufacturing costs of the plates 20 and also allows the use of only one plate 20 per door, installed on either the strike plate side or hinge side thereof, to reduce installation costs for the consumer. An additional advantage of identical plates 20 attached to the hinge jamb 61 and the strike jamb 62 is that additional locking devices 74 can be installed in the door 70 at heights on the door 70 generally opposing the top and the bottom hinges 72. That is, in one embodiment, the door 70 may have three locking devices 74 in approximate heightwise correspondence to the three hinges 72 also attached thereto. The plate 20 attached to the strike jamb 62 and having three openings 50 further allows for different spacings and alignment of the strike plates 64. Accordingly, before the frame 60 is installed, a plate 20 is placed on the back side of the strike jamb 62, with the openings 50 roughly aligned with the locations of the strike plate(s) 64, and secured thereto by fasteners 90 passing through the attachment holes 30 in the plate 20 and into the back side of the strike jamb 62. The fasteners 90 attaching the plate 20 to the strike jamb 62 may be, for example, screws, nails, or the like and of sufficient length to secure the plate 20 to the strike jamb 62 without passing completely through the jamb. Note that, while a typical pre-hung door unit has one or possibly two locking devices, there may be instances where the unit has just one or more than three such locking devices. It is understood that the door frame reinforcing structure of the present invention is adaptable to these cases by increasing or decreasing the number, spacing, or dimensions of the openings therein in an appropriate manner without departing from the scope and spirit of the present invention. Thus, since the same plate 20 can be used for both the hinge jamb 61 and the strike jamb 62 and since the plates 20 can accommodate different spacings and alignments of hinges 72 and locking devices 74 without requiring modification of the plates or complex alignment thereof, a "universal" door frame reinforcement structure 10 for attachment to a wide variety of pre-hung door units is provided by a preferred embodiment of the present invention.

Figure 3:
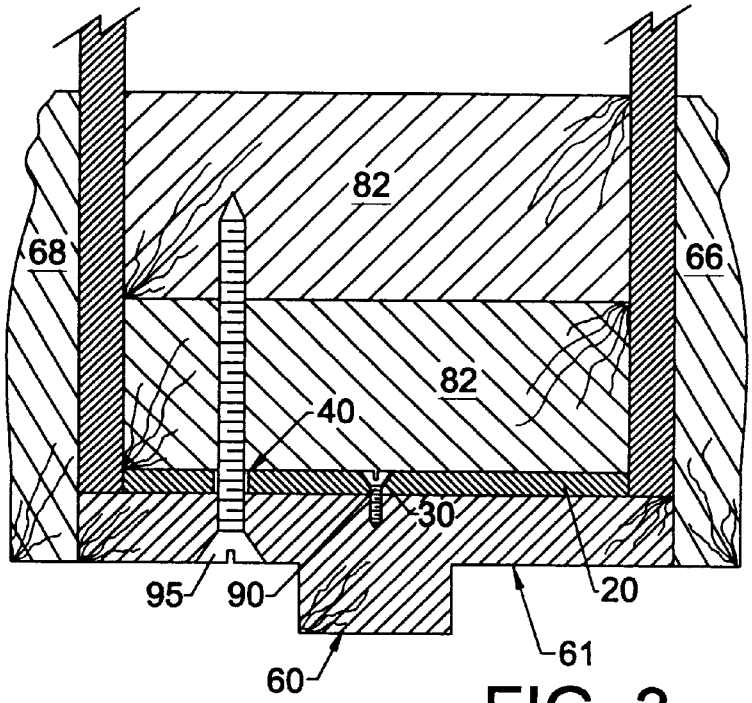
FIG. 3 is a cross-sectional view of a preferred embodiment of the present invention taken through line 3—3 in FIG. 2, wherein a plate is attached to the back of a door jamb and installed between the door jamb and the framed opening with fasteners passing through the jamb, installation holes in the plate, and into an adjacent member of the framed opening.
Figure 4:
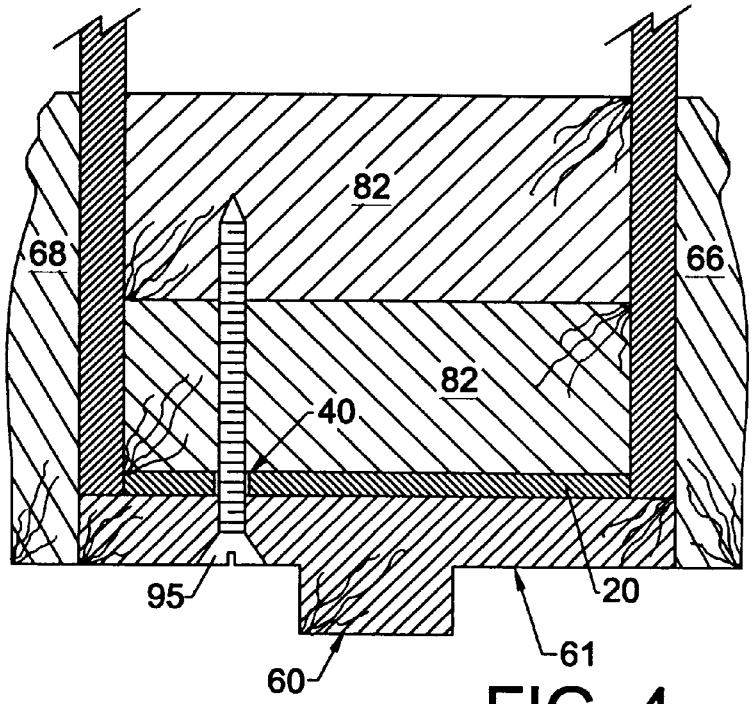
FIG. 4 is a cross-sectional view of a preferred embodiment of the present invention taken through line 4—4 in FIG. 2, wherein a plate is installed between a door jamb and the framed opening with fasteners passing through the jamb, installation holes in the plate, and into an adjacent member of the framed opening.

As shown in FIG. 3, once the plates 20 have been attached to the jambs 61 and 62 of the door frame 60, the plates 20 are used as templates for drilling holes used to secure the door frame 60 within the framed opening 80. That is, the installation holes 40 are used as drill guides in order to drill corresponding holes 45 (which may be, for example, ¼ inch diameter holes) in the adjacent jambs 61 and 62, thus preparing the frame 60 for installation in the framed opening 80. As previously described, the frame 60 is slid into the framed opening 80 until the outer molding 66 is flush against the outer wall surface. The frame 60 is then aligned within the framed opening 80, typically with shims. Thus, as shown in FIGS. 3 and 4, to secure the frame 60 within the framed opening 80, long fasteners 95 are applied to the frame 60, passing through the holes 45 in the jambs 61 and 62, the corresponding installation holes 40 in the plates 20, and into adjacent framing members 82. Long fasteners 95 may be, for example, long screws, nails, or the like of sufficient length to pass through the frame 60 and sufficiently into an adjacent framing member 82. In one embodiment of the present invention, where the frame 60 and the framing members 82 are comprised of wood, the long fasteners 95 are preferably screws about four inches long and up to ¼ inch in diameter to pass through the corresponding holes 45. An inner molding 68 is then applied to the frame 60 in an overlapping manner around the top and the sides of the inner edge thereof, forming a lip. The inner molding 68 further extends across to the inner wall surface, thus completing the installation of the frame 60 having the attached door frame reinforcing structure 10.

The plates 20 are concealed from view when installed according to the preferred embodiment of the present invention, and will not interfere with the interior decor or moldings of the building/room. Besides the aesthetic advantage, the concealed apparatus 10 also provides an element of surprise for an intruder not expecting a reinforced door unit. Further, even if the outer molding 66 is removed from the outer wall side of the frame 60, the frame 60 cannot be pushed through the framed opening 80 (thereby allowing entry into the building/room) since the frame 60 is now securely fastened to the adjacent framing members 82 forming the framed opening 80.

With the frame 60 secured within the framed opening 80 by the long fasteners 95 passing through the jambs 61 and 62, the plates 20, and into the adjacent framing members 82, a composite (for example, a wood-metal-wood composite where the framing members 82 and the frame 60 are made of wood) is thereby generally formed with the long fasteners 95 securing the composite layers together. Since the frame 60 is part of a pre-hung door unit, the door 70 is already aligned and installed in the frame 60. Accordingly, once the reinforced frame 60 has been installed, the fasteners which hold the hinges 72 and the strike plate(s) 64 to the corresponding jambs 61 and 62 are removed. The fasteners for fastening the hinges 72 and the strike plate(s) 64 to the corresponding jambs 61 and 62 of a typical pre-hung door are typically short in length, on the order of about ½ inch to an inch long. The short fasteners are then replaced with long fasteners 95 which are of sufficient length to pass through the hinges 72/strike plate(s) 64, the corresponding jamb 61 or 62, the corresponding opening 50 in the plate 20, and into an adjacent framing member 82. The long fasteners 95 may be, for example, 4 inch long screws. Thus, another layer is added to the composite in the area of the hinges 72 and the strike plate 64, thereby forming, for example, a metal-wood-metal-wood composite where the framing members 82 and the frame 60 are made of wood. Therefore, with the door frame reinforcing apparatus 10 installed, a force applied to the door 70 will still result in the stresses being concentrated at the hinge areas of the hinge jamb 61 and the strike plate area of the strike jamb 62. However, both jambs 61 and 62 are now composite structures (which includes the framing members comprising a portion of the rest of the wall) and thus have a higher resistance to an applied breaking force since the force is distributed over a larger area in both jambs 61 and 62, extending through to the framing members 82 of the wall. In addition, with the long fasteners 95 extending generally through the frame 60, the plates 20, and into the framing members 82, the reinforced door unit will be less prone to racking since layers of the composite structure are less likely to move relative to each other than are adjacent, unfastened framing members 82.

Figure 5:
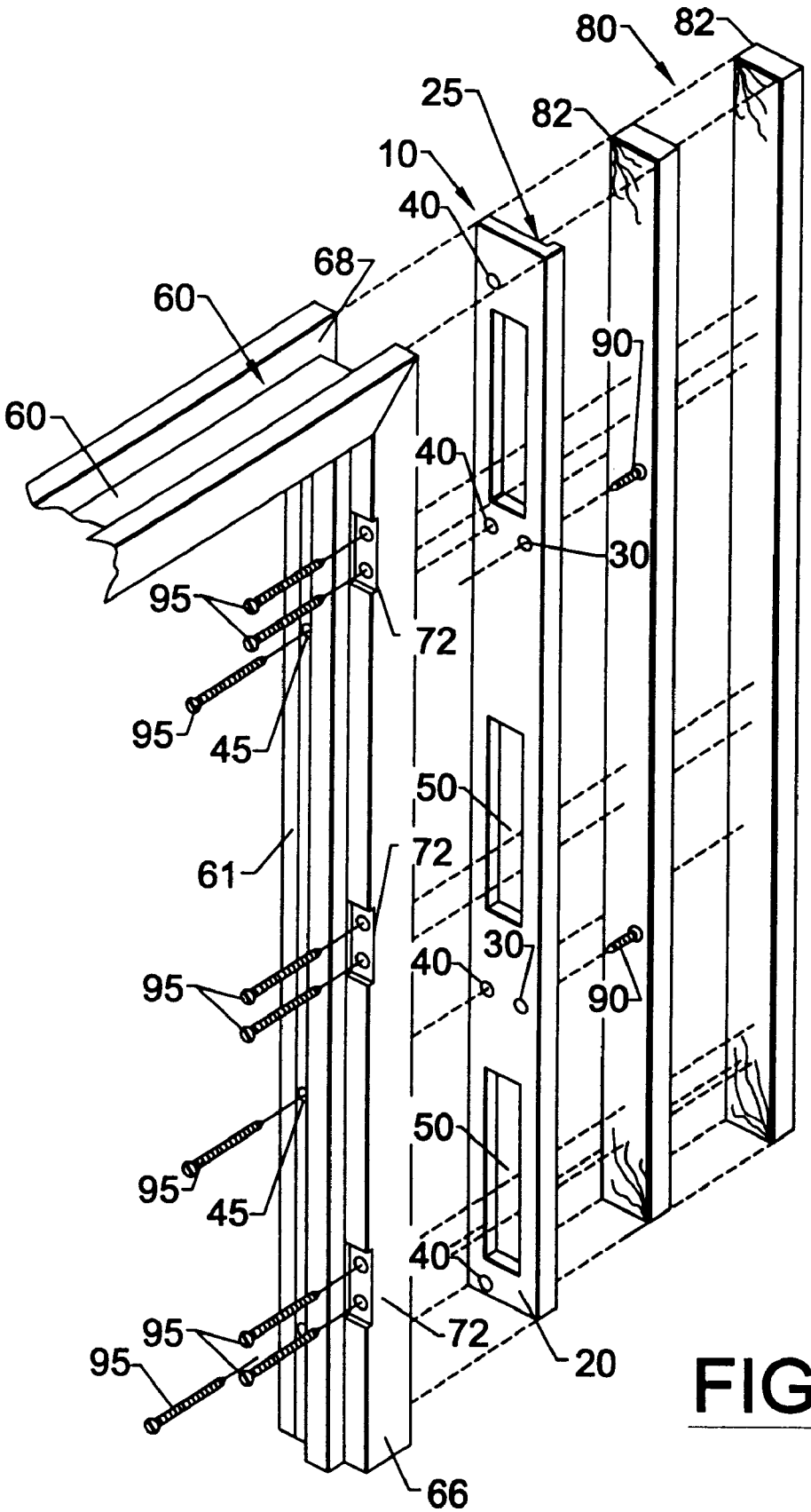
FIG. 5 is an exploded perspective view of an alternate embodiment of the door frame reinforcing structure of the present invention showing a plate between the frame and adjacent framing members.

In an alternate embodiment of the present invention as shown in FIG. 5, each of the plates 20 may further comprise a return 25, wherein the return 25 is a generally perpendicular member protruding from the plate 20 for the length thereof, which functions to stiffen the plate 20. In an embodiment of the present invention, for example, the return 25 protrudes from the plate for about ⅛ inch and is located along a lengthwise edge of the plate 20. Where the plates 20 each include a return 25, the plates 20 are installed on the frame 60 such that the return 25 is directed away from the frame 60 toward the adjacent framing members 82. If necessary to accommodate the return 25, the adjacent framing members 82 on either side of the framed opening 80 may be machined or modified with a groove or slot to accept the return 25 therein.

In accordance with a preferred embodiment of the present invention, a preferred method for reinforcing a door frame installed in a framed opening comprises a first step of attaching a pair of metal plates individually on the back side of each of the jambs forming the sides of the frame. The plates are attached individually to the back side of each of the jambs by a plurality of fasteners passing through a corresponding plurality of attachment holes defined by the plates and into the jambs. After the plates are attached to the jambs, the door frame is installed in the framed opening with fasteners passing through the jambs, a plurality of installation holes further defined by each metal plate, and into adjacent members of the framed opening. Once the door frame is secured within the framed opening, a plurality of hinges is then secured to the front side of the hinge jamb by fasteners passing through the hinges, the hinge jamb, a plurality of elongated openings further defined by the plate attached to the hinge jamb, and into an adjacent member of the framed opening. Having secured the door on the hinges, at least one strike plate is then secured to the front side of the strike jamb by fasteners passing through the strike plate, the strike jamb, at least one elongated opening further defined by the plate attached to the strike jamb, and into an adjacent member of the framed opening.

In an alternate embodiment of the present invention, the plates 20 may be retro-fitted on a door frame 60 which is already installed in a framed opening 80. In this embodiment, the inner molding 68 is removed from around the inner wall side of the frame 60. The plates 20 are then individually inserted into the spaces between the jambs 61 and 62 and the adjacent framing members 82 on either side of the frame 60. Since the plates 20 are of substantially the same dimensions as the jambs 61 and 62, the openings 50 will generally self-align with the locations of the hinges 72 and the strike plate(s) 64. Forming the reinforced composite door frame 60 is then accomplished by removing the short fasteners securing the hinges 72 and strike plate(s) 64 to their respective jambs 61 and 62, and replacing those with long fasteners 95 passing through the hinges 72/strike plate (s) 64, the corresponding jamb 61 or 62, the corresponding opening 50 in the plate 20, and into an adjacent framing member 82.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A reinforced door assembly for installation in a plurality of interconnected framing members defining a framed opening, said assembly comprising:

a door frame having a hinge jamb and a strike jamb and accommodated within the framed opening, each jamb having a back side adjacent a framing member and an opposing front side facing away therefrom;

a door received within the door frame and having a first vertical edge spaced apart from a second vertical edge;

a hinge side metal plate extending substantially the length and width of the hinge jamb and attached to the back side thereof, said hinge side plate defining a plurality of hinge mounting slots for allowing attachment of corresponding hinges to the front side of the hinge jamb;

at least one fastener passing through each of the hinges, the hinge jamb, the hinge mounting slots, and into the adjacent framing member, the hinges further being attached to the first vertical edge of the door;

a strike plate side metal plate extending substantially the length and width of the strike jamb and attached to the back side thereof, said strike plate side plate defining at least one strike plate mounting slot for allowing attachment of at least one strike plate to the front side of the strike jamb; and at least one fastener passing through said strike plate, the strike jamb, said strike plate mounting slot, and into the adjacent framing member, said strike plate further engaging at least one corresponding locking device attached along the second vertical edge of the door.

2. An assembly according to claim 1 wherein each of said metal plates includes three respective slots, wherein said slots are elongate and spaced apart along the length of said metal plates.

3. An assembly according to claim 2 wherein said three strike plate mounting slots in the metal plate attached to the strike jamb allow attachment of a plurality of strike plates to the front side of the strike jamb by fasteners passing through each of said strike plates, the strike jamb, the corresponding strike plate mounting slot, and into an adjacent framing member.

4. An assembly according to claim 2 wherein said three hinge mounting slots in the metal plate attached to the hinge jamb allow attachment of up to three hinges to the front side of the hinge jamb by fasteners passing through each of said up to three hinges, the hinge jamb, the corresponding hinge mounting slot, and into an adjacent framing member.

5. An assembly according to claim 1 wherein each of said metal plates are comprised of at least 12 gauge steel.

6. An assembly according to claim 1 wherein each of said metal plates are at least about 3 inches wide and between about 70 inches and about 110 inches long.

7. An assembly according to claim 1 wherein each of said metal plates further include at least one return, said return in the form of a perpendicular member protruding from a lengthwise edge of the metal plate for stiffening the metal plate, said metal plates with at least one return being attached to the door jambs such that said at least one return is directed away therefrom.

8. An assembly according to claim 7 wherein said at least one return protrudes from a lengthwise edge of said metal plate for a distance of about 0.125 inches.

9. An assembly according to claim 1 wherein the hinge side metal plate and the strike plate side metal plate are substantially identical.

10. An assembly according to claim 1 wherein each of said metal plates further defines a plurality of attachment holes for attaching said metal plates individually to the back sides of the jambs with fasteners passing therethrough.

11. An assembly according to claim 1 wherein each of said metal plates further defines a plurality of installation holes for securing the door frame in the framed opening and further comprising additional fasteners passing through the jambs, the installation holes, and into an adjacent framing member.

12. An apparatus adapted to reinforce a door frame for installation in a plurality of interconnected framing members defining a framed opening, the door frame comprising a hinge side jamb adapted to engage a plurality of hinges on a front side thereof and having an opposing back side and a strike plate side jamb adapted to engage at least one strike plate on a front side thereof and having an opposing back side, said apparatus comprising:

an elongate metal plate adapted to extend substantially the length and width of at least one of the hinge side jamb and the strike plate side jamb;

said metal plate further defining:

a plurality of attachment holes adapted to accommodate a first set of fasteners passing therethrough for attaching the metal plate to the back side of at least one of the hinge side jamb and the strike plate side jamb; and a plurality of slots corresponding to the plurality of hinges and the at least one strike plate such that the metal plate is substantially interchangeable between the hinge side jamb and the strike plate side jamb, the slots adapted to accommodate a second set of fasteners for securing at least one of the plurality of hinges and the at least one strike plate to the front side of the respective jamb, the second set of fasteners further passing through the respective jamb, the corresponding slot, and into an adjacent framing member.

13. An apparatus according to claim 12 wherein said metal plate is comprised of at least 12 gauge steel.

14. An apparatus according to claim 12 wherein said metal plate further defines installation holes for securing the door frame to the framed opening with fasteners passing through a jamb, the installation holes, and into an adjacent framing member.

15. An apparatus according to claim 12 wherein said slots are elongate and spaced apart along the length of said metal plate.

16. An apparatus according to claim 15 wherein said metal plate includes three slots.

17. An apparatus according to claim 12 wherein said metal plate further includes at least one return, said return in the form of a perpendicular member protruding from a lengthwise edge of the metal plate for stiffening the metal plate.

18. An apparatus according to claim 17 wherein said at least one return protrudes from a lengthwise edge of said metal plate for a distance of about 0.125 inches.

* * * * *

UNITED STATES PATENT AND TRADEMARK OFFICE

CERTIFICATE OF CORRECTION

PATENT NO. : 6,178,700 B1
DATED : January 30, 2001
INVENTOR(S) : Mayer, Jr.

It is certified that error appears in the above-identified patent and that said Letters Patent is hereby corrected as shown below:

Title page,
Item [56] References Cited, U.S. PATENT DOCUMENTS,
Line 16, "5,193,380" should read -- 5,193,308 --.

Signed and Sealed this

Sixth Day of November, 2001

*Attest:*

Nicholas P. Godici

NICHOLAS P. GODICI
*Acting Director of the United States Patent and Trademark Office*

*Attesting Officer*